US006050861A

United States Patent [19]

Genta et al.

[11] Patent Number: 6,050,861

[45] Date of Patent: Apr. 18, 2000

[54] ELECTRIC CONNECTOR

[75] Inventors: Alessandro Genta, Turin; Roberto Bortoloni, Settimo Torinese, both of Italy

[73] Assignee: Framatome Connectors International, Courbevoie, France

[21] Appl. No.: 08/945,361

[22] PCT Filed: Apr. 24, 1996

(Under 37 CFR 1.47)

[86] PCT No.: PCT/EP96/01714

§ 371 Date: Feb. 26, 1998

§ 102(e) Date: Feb. 26, 1998

[87] PCT Pub. No.: WO96/34429

PCT Pub. Date: Oct. 31, 1996

[30] Foreign Application Priority Data

Apr. 26, 1995 [IT] Italy ..... TO95A0324

[51] Int. Cl.[7] ..... H01R 13/436

[52] U.S. Cl. ..... 439/752

[58] Field of Search ..... 439/752, 595, 439/596

[56] References Cited

U.S. PATENT DOCUMENTS

| | | | |
|---|---|---|---|
| 4,705,337 | 11/1987 | Maeda | 439/595 |
| 4,767,361 | 8/1988 | Hoshino et al. | 439/596 |
| 5,316,504 | 5/1994 | Jinno | 439/752 |
| 5,501,619 | 3/1996 | Sakatani et al. | 439/752 |
| 5,700,162 | 12/1997 | Hatagishi et al. | 439/752 |
| 5,716,235 | 2/1998 | Endo et al. | 439/596 |
| 5,769,670 | 6/1998 | Abe | 439/752 |

FOREIGN PATENT DOCUMENTS

| | | |
|---|---|---|
| 0 606 903 | 7/1994 | European Pat. Off. . |

*Primary Examiner*—Gary F. Paumen
*Attorney, Agent, or Firm*—Perman & Green, LLP

[57] ABSTRACT

An electric connector (1) presenting an insulating casing (2) with a number of axial cavities (3); a number of electric terminals (4) housed inside respective cavities (3); primary retaining means (17) for retaining the terminals (4) inside the cavities (3); and a secondary retaining device (26) in turn presenting a movable element (27) which snaps on to the casing (2) into an activating position of the secondary retaining device (26); the casing (2) and the movable element (27) being formed in one piece in the deactivating position of the secondary retaining device (26), and being connected integral with each other by yielding means (28); and the movable element (27) being movable between the deactivating and activating positions by means of a straightforward translatory movement.

17 Claims, 7 Drawing Sheets

ELECTRIC CONNECTOR

TECHNICAL FIELD

The present invention relates to an electric connector, particularly of the type comprising an outer insulating casing defining at least one axial cavity, and an electric terminal housed and retained inside the cavity by primary retaining means.

BACKGROUND ART

Known electric connectors of the above type comprise a secondary retaining device for ensuring correct insertion and further ensuring retention of the terminals inside the respective cavities.

The device normally comprises an element movable in relation to the casing, and which snaps on to the casing to cooperate with the terminals or the primary retaining means and so prevent accidental withdrawal of the terminals. Snap-on connection of the movable element to the casing is only possible when the terminals are correctly inserted and retained inside the cavities by the primary retaining means.

In one known embodiment, the movable element is integral with and hinged to the casing, and therefore presents a substantially rotary movement which, for functional and dimensional reasons, limits its application scope.

In other embodiments, the movable element is separate from and translated in relation to the casing.

This solution also presents drawbacks. In particular, it involves producing and handling two separate parts (the casing and movable element); and connection of the two parts involves a certain amount of precision and, when performed manually, the use of both hands. To simplify handling and assembly by the wirer, the movable element is frequently preassembled to the casing, thus adding a further preliminary stage which also involves a certain amount of difficulty.

DISCLOSURE OF INVENTION

It is an object of the present invention to provide an electric connector designed to overcome the aforementioned drawbacks typically associated with known types.

According to the present invention, there is provided an electric connector comprising an insulating casing with at least one axial cavity; at least one electric terminal housed inside said cavity; primary retaining means for retaining said terminal inside said cavity; and secondary retaining means in turn comprising at least one movable element which snaps on to the casing into an activating position of said secondary retaining means to determine correct engagement of the terminal by said primary retaining means and prevent withdrawal of the terminal; characterized in that said casing and said movable element are formed in one piece in the deactivating position of said secondary retaining means; said secondary retaining means comprising yielding means integrally connecting said movable element to said casing at least in said deactivating position of said secondary retaining means; and said movable element being movable between said deactivating and said activating positions by means of a straightforward translatory movement.

BRIEF DESCRIPTION OF THE DRAWINGS

Two preferred, non-limiting embodiments of the present invention will be described by way of example with reference to the accompanying drawings, in which.

BEST MODE FOR CARRYING OUT THE INVENTION

Figure 1:
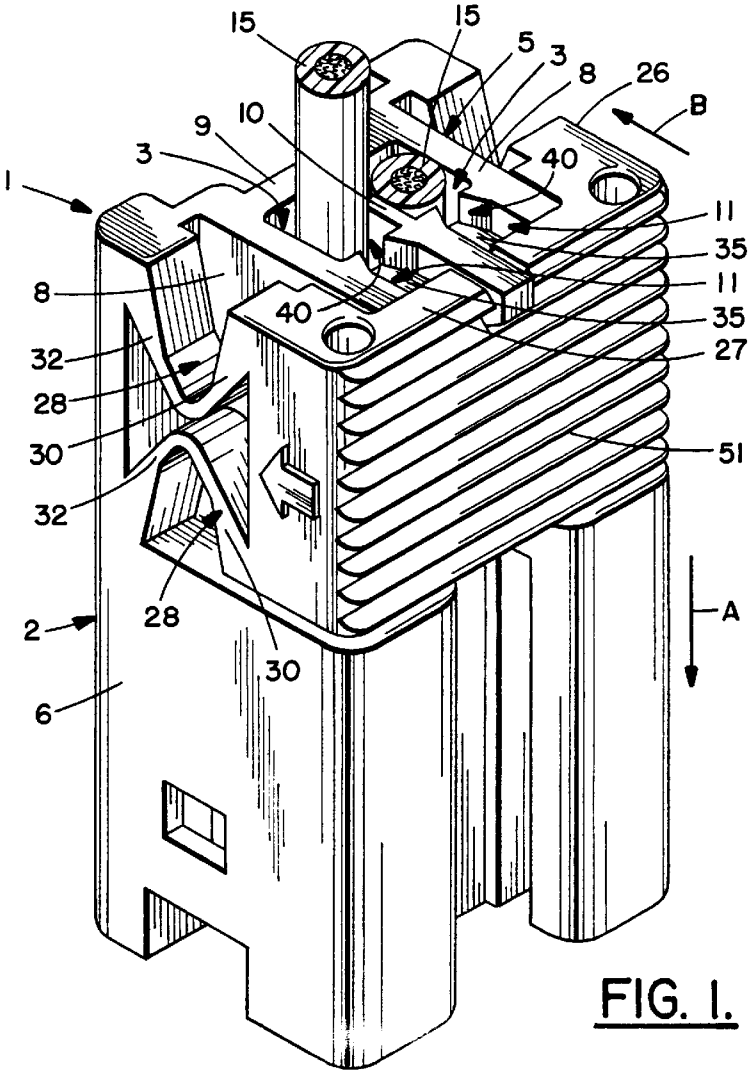
FIGS. 1 and 2 show two views in perspective of a first embodiment of an electric connector in accordance with the teachings of the present invention, and in two different operating positions.
Figure 2:
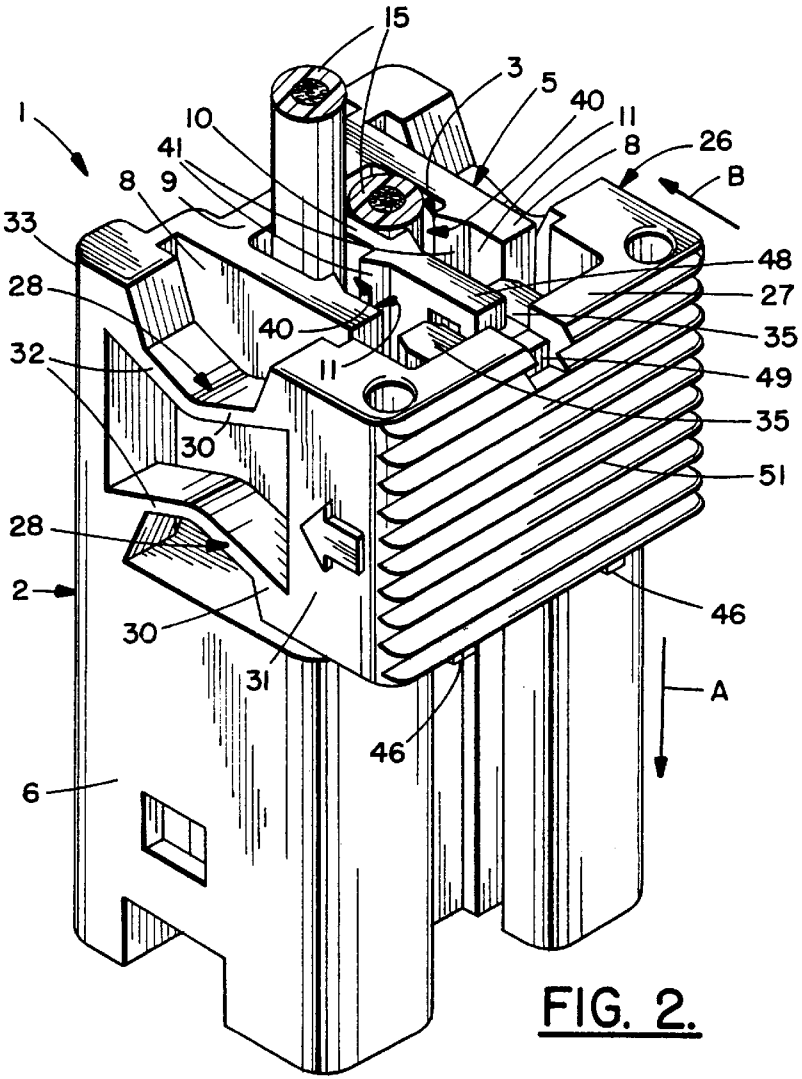

Number 1 in FIGS. 1 to 7 indicates an electric connector, particularly for an automotive airbag activating device.

Connector 1 substantially comprises an insulating casing 2 defining two longitudinal through cavities 3; and two male electric terminals 4 housed inside respective cavities 3, with their axes "a" parallel to the connection direction A of connector 1 to a complementary connector (not shown).

More specifically, and with reference to FIGS. 1, 2, 6 and 7, casing 2 comprises a rear portion 5 in which cavities 3 for terminals 4 are formed; and a hollow front portion 6 with a larger cross section than portion 5 and defining a chamber 7 for receiving a correspondingly shaped portion of a complementary connector (not shown) and communicating with each of cavities 3.

Rear portion 5 comprises two opposite lateral walls 8; a lateral wall 9 perpendicular to and connected integral with walls 8; and an intermediate wall 10 extending parallel to walls 8 from wall 9 and defining a respective cavity 3 with each of walls 8. Cavities 3 therefore communicate externally through respective longitudinal openings 11 between wall 10 and each of walls 8.

Figure 6:
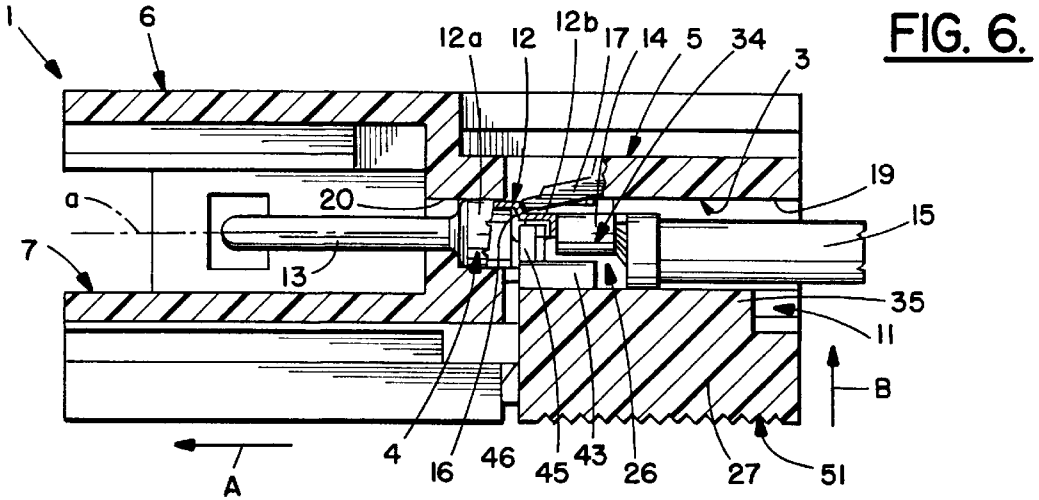
FIG. 6 shows a section along line VI—VI in FIG. 4.
Figure 7:
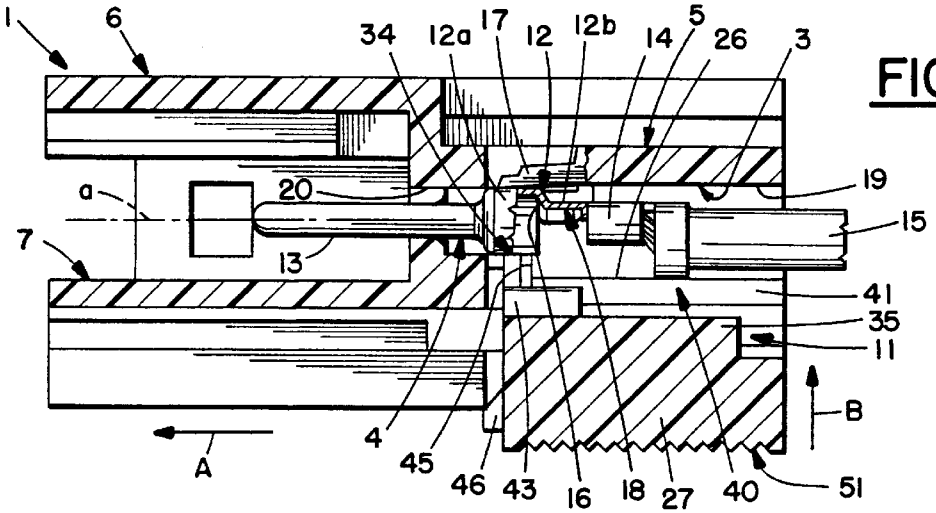
FIG. 7 shows a section along line VII—VII in FIG. 5, in an incorrect assembly position.
Figure 3:
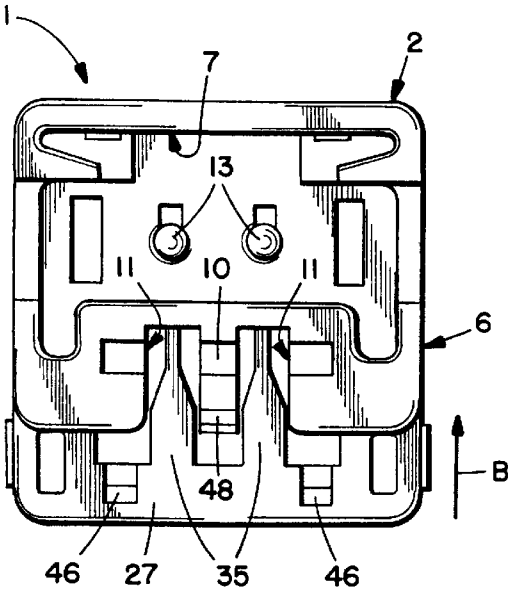
FIG. 3 shows a front view of the connector in the FIG. 2 position.

With reference to FIGS. 6 and 7, each terminal 4 comprises an intermediate portion 12; a contact portion 13 in the form of a cylindrical pin and projecting frontwards from intermediate portion 12; and a rear portion 14 for connection to an electric cable 15.

Intermediate portion 12 comprises a cylindrical portion 12*a* adjacent to contact portion 13; and a substantially semicylindrical portion 12*b* adjacent to connecting portion 14.

Portion 12*b* is smaller in diameter than portion 12*a* so as to define with it an axial shoulder 16 acting as a stop surface for an elastic retaining lance 17 projecting integrally from wall 9, and defines a seat 18 facing a respective opening 11 and the function of which is described later on. Lance 17 slopes frontwards and inwards of the cavity so as to permit insertion but prevent withdrawal of terminal 4.

Contact portion 13 of each terminal 4 projects axially inside chamber 7 of portion 6 through a front opening 20 of cavity 3; and respective cable 15 projects from casing 2 through a rear opening 19 of cavity 3.

Connector 1 also presents a secondary retaining device for retaining terminals 4 and indicated as a whole by 26.

Device 26 comprises a movable wall element 27 (hereinafter referred to simply as "wall 27") facing longitudinal openings 11 in portion 5 of casing 2, and located in a plane substantially parallel to the axes "a" of terminals 4. Wall 27 is movable in relation to casing 2 in a direction B perpendicular to itself and to the plane π containing the axes "a" of terminals 4, and snaps on to portion 5 when terminals 4 are correctly inserted inside respective cavities 3 (FIGS. 1, 4, 6).

Figure 4:
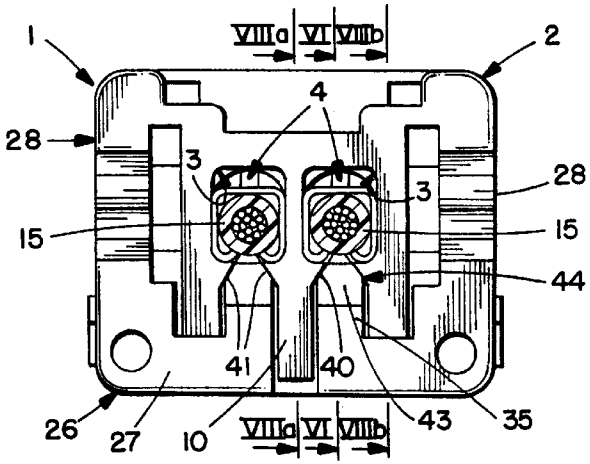
FIG. 4 shows a rear view of the connector in the FIG. 1 position.
Figure 10:
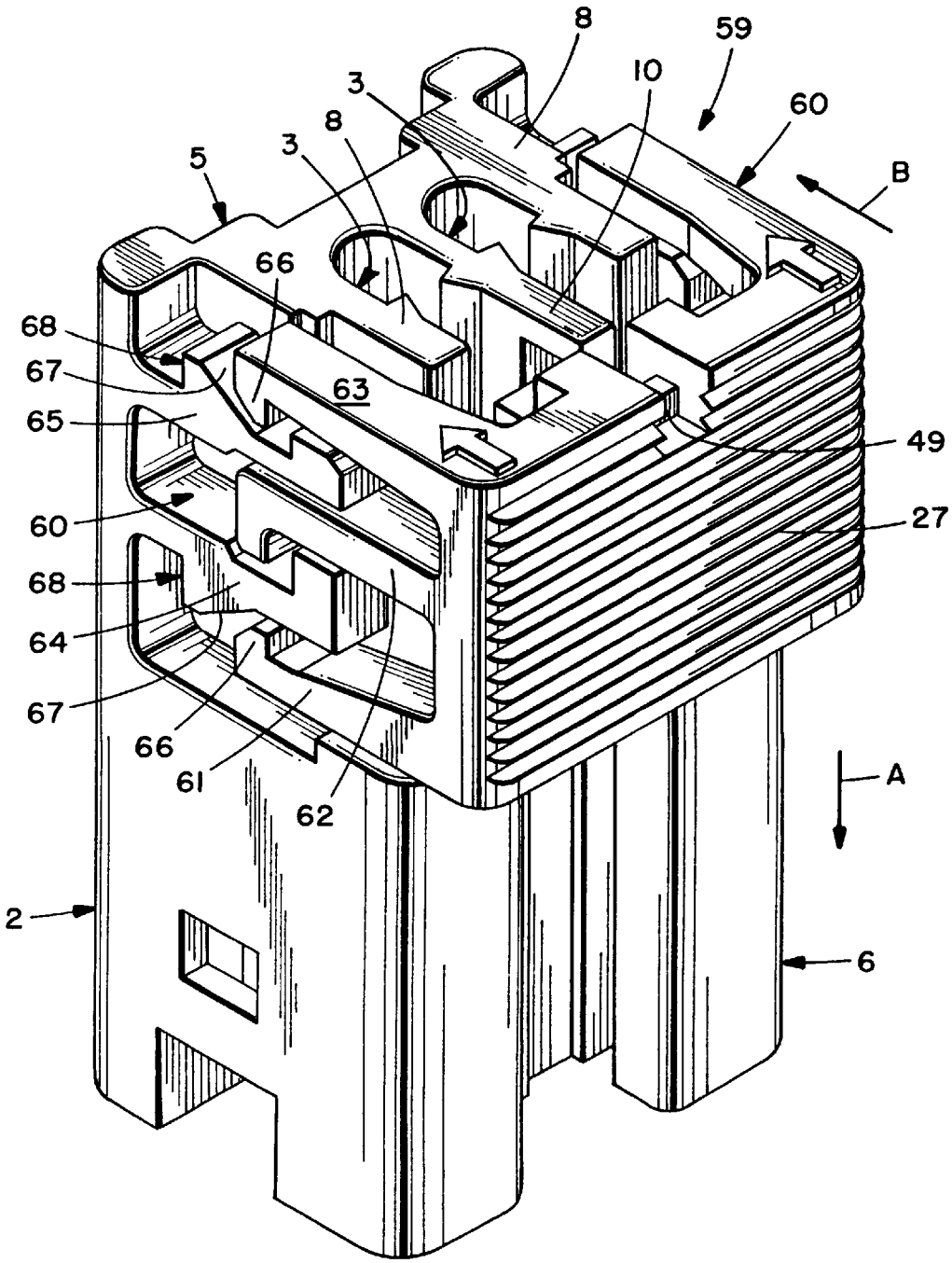
FIG. 10 shows a view in perspective of a second embodiment of an electric connector in accordance with the teachings of the present invention.
Figure 11:
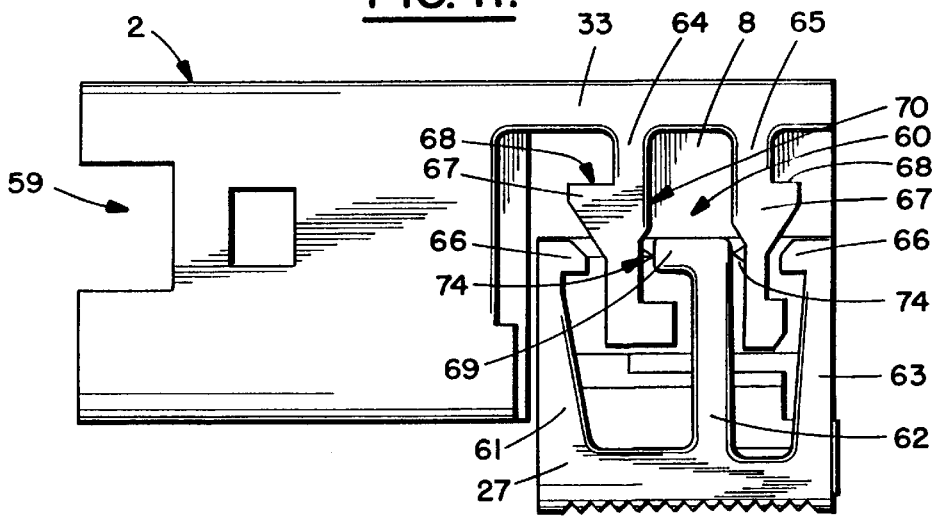
FIG. 11 shows a side view of the FIG. 10 connector.
Figure 12:
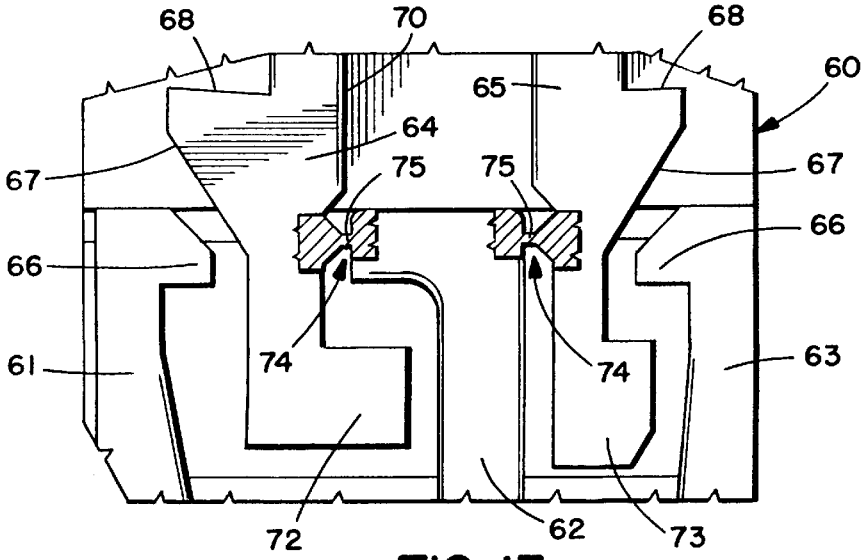
FIG. 12 shows a larger-scale, partly sectioned detail of FIG. 10.

Device 26 also comprises a number of deformable blades 28 integrally connecting wall 27 to portion 5, and which flex substantially elastically to permit wall 27 to translate in direction B between a position wherein device 26 is deactivated and wherein wall 27 itself is detached,from portion 5 (FIGS. 2, 3, 5, 7), and an activating position wherein wall 27 is fitted to portion 5 and flush with portion 6 (FIGS. 1, 4, 6).

More specifically, blades 28 are four in number, arranged in twos on either side of portion 5 and outside respective lateral walls 8; and each blade 28 presents a first end 30 integral with a corresponding lateral portion 31 of wall 27, and a second end 32 integral with a corresponding longitudinal rib 33 forming part of and extending along the edge of portion 5 opposite wall 27.

Blades 28 in each pair are arranged facing each other; curve in a plane parallel to walls 8 with their convexities facing each other so as to flex in a predetermined direction; and present an elongated cross section in the direction perpendicular to walls 8 (i.e. crosswise to directions A and B) so as to be substantially rigid in this direction and prevent any undesired lateral shift of wall 27.

Wall 27 comprises two engaging portions 34 which cooperate with respective terminals 4 and in turn comprise respective longitudinal projections 35 at respective longitudinal openings 11 of portion 5 of casing 2. Each projection 35 presents a front centering portion 36 defined laterally by two inclined sides 38 converging towards respective cavity 3, and which fits inside a corresponding flared lead-in seat 40 formed in portion 5 and defined laterally by inclined surfaces 41 (FIGS. 2, 4) formed respectively on a lateral wall 8 and on intermediate wall 10.

Figure 9:
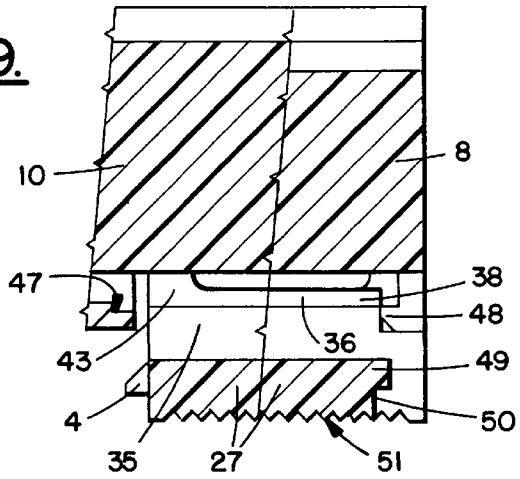
FIG. 9 shows a partial section, the right-hand portion along line IXa—IXa and the left-hand portion along line IXb—IXb in FIG. 5.
Figure 8:
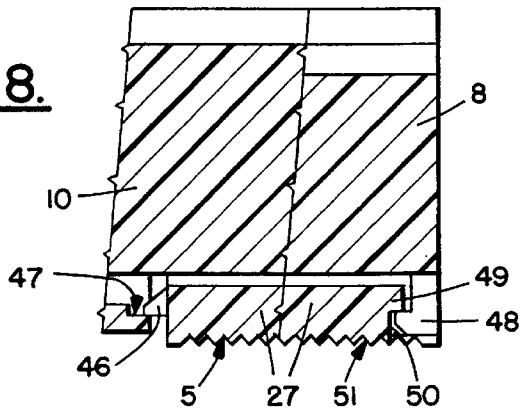
FIG. 8 shows a partial section, the right-hand portion along line VIIIa—VIIIa and the left-hand portion along line VIIIb—VIIIb in FIG. 4.
Figure 5:
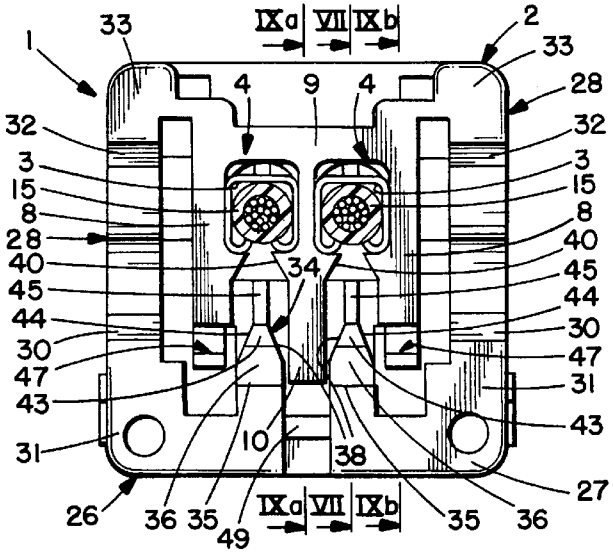
FIG. 5 shows a rear view of the connector in the FIG. 2 position.

Each portion 34 also comprises a tapered appendix 43 projecting from the front end of front portion 36 of projection 35 (FIGS. 7, 9), and which is defined laterally by inclined surfaces 44 coplanar with sides 38 (FIGS. 4, 5), and presents a front tooth 45 so sized and located as to only fit inside seat 18 of terminal 4 when this is correctly inserted inside respective cavity 3.

Wall 27 is snapped on to casing 2 into the activating position by means of a pair of front lateral teeth 46 (FIGS. 2, 8, 9) which snap inside respective seats 47 formed in casing 2, and by means of a central rear hook 48 on casing 2, which snaps on to a projection 49 formed on the rear edge of wall 27 (FIGS. 1, 2, 8, 9).

Finally, wall 27 presents a knurled outer surface 51 to prevent slippage when wall 27 is pushed manually into said activating position.

Connector 1 is assembled as follows.

Casing 2 and device 26 are formed in one piece in the deactivating position (FIG. 2) wherein blades 28 are undeformed, and teeth 45 of appendixes 43 are housed inside respective openings 11 and withdrawn in relation to cavities 3.

In this position, terminals 4 are inserted inside respective cavities 3.

Wall 27 is then pushed in direction B and snapped on to portion 5 of casing 2, thus flexing blades 28 in the plane parallel to walls 8.

At this point, two situations may arise.

If terminals 4 are inserted fully inside respective cavities 3 and correctly engaged by respective lances 17 (FIG. 6), when wall 27 is pushed in direction B, projections 35 are inserted between respective walls 8 and wall 10, thus laterally centering wall 27 by appendixes 43 engaging respective flared seats 40; and, upon wall 27 reaching the end of its travel, teeth 45 fit inside seats 18 of terminals 4, appendixes 43 are positioned behind respective cylindrical portions 12a of the terminals, thus preventing withdrawal, and teeth 46 and hook 48 lock wall 27 to casing 2 in the activating position of device 26 described above.

Conversely, in the event either of terminals 4 is not fully inserted and correctly engaged by lance 17, seat 18 does not correspond with tooth 45 (FIG. 7), thus preventing wall 27 from being fitted to portion 5 of casing 2, due to tooth 45 interfering with portion 12*a* when wall 27 is pushed in direction B, and thus enabling the error to be detected immediately.

FIGS. 10 to 17 show an electric connector 59 according to a further embodiment of the present invention, and which is described only in so far as it differs from connector 1, and using the same numbering system for any parts similar or identical to those already described.

Connector 59 comprises a casing 2 and wall 27 identical to those of connector 1, formed in one piece, and connected to each other by retaining means indicated as a whole by 60.

For each side of the connector, retaining means 60 substantially comprise three arms 61, 62, 63 extending integrally and perpendicularly from wall 27 along respective lateral wall 8 of portion 5 of casing 2; and two arms 64, 65 extending integrally from respective rib 33 of casing 2 towards wall 27, and interposed between intermediate arm 62 and arms 61 and 63 respectively. Arms 61, 62, 63 are therefore offset in relation to arms 64, 65 in direction A, and are slidable in direction B.

Arms 61, 63 are flexible, and present respective end teeth 66 respectively facing arms 64, 65; and arms 64, 65 present respective lateral ramps 67 respectively facing arms 61, 63, and which slope upwards towards rib 33 and are defined, towards rib 33, by respective sides 68 perpendicular to arms 64, 65.

Intermediate arm 62 presents a laterally bent end portion 69 which slides inside a seat 70 formed between respective base portions of arms 64, 65; and arms 64, 65 in turn present respective lateral end appendixes 72, 73 which cooperate respectively with portion 69 of arm 62 and tooth 66 of arm 63 in the fully detached position of wall 27 and casing 2, to prevent wall 27 from being fully released from casing 2.

Casing 2 and wall 27 are connected integral with each other by two breakable connecting elements 74 (FIGS. 11, 12, 13) interposed between end portion 69 of arm 62 and respective intermediate portions of arms 64, 65, and presenting a substantially truncated-cone-shaped structure with the wider end integral with arm 64 or 65 and the narrower end connected to arm 62 by a thin cylindrical bead 75 defining a break section.

Figure 13:
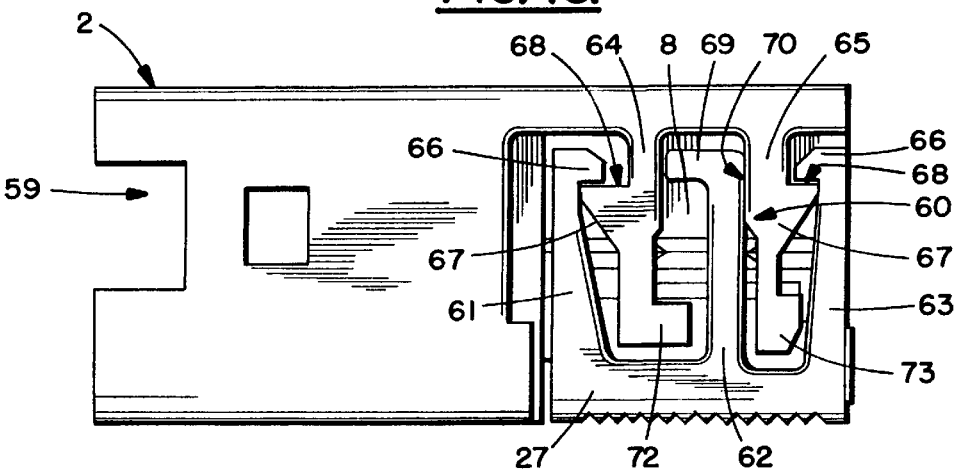
FIG. 13 shows a side view of the FIG. 10 connector in a different operating position.
Figure 14:
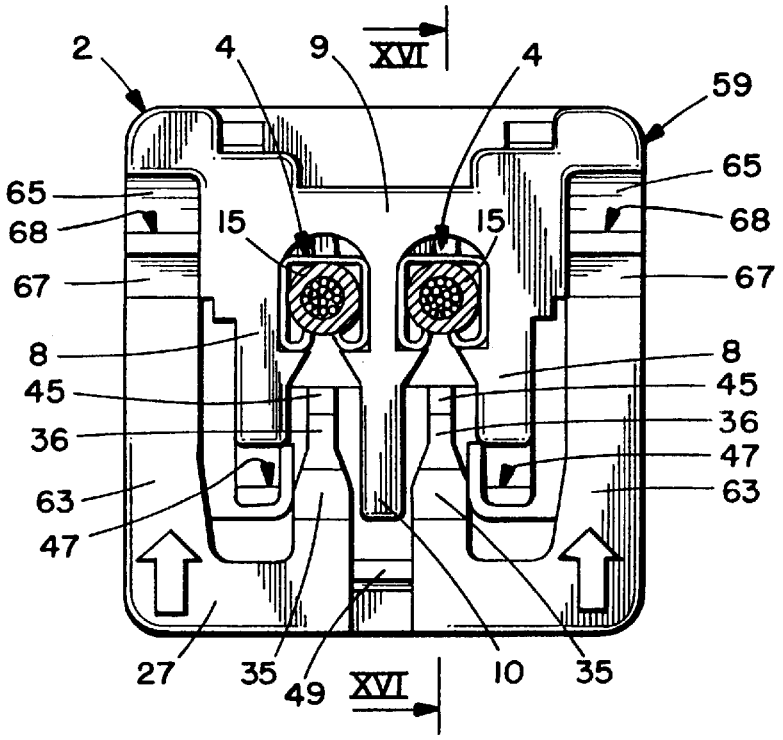
FIGS. 14 and 15 show rear views of the FIG. 10 connector in the FIG. 11 and FIG. 13 positions respectively.
Figure 15:
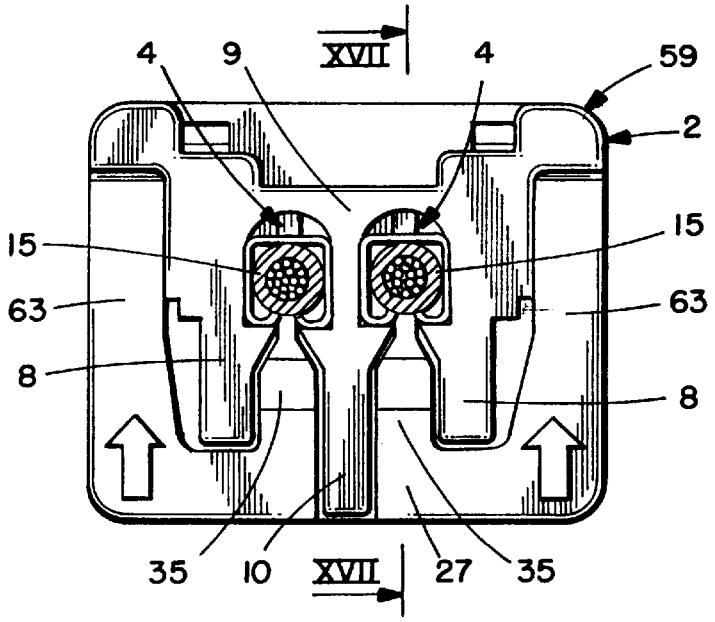
Figure 16:
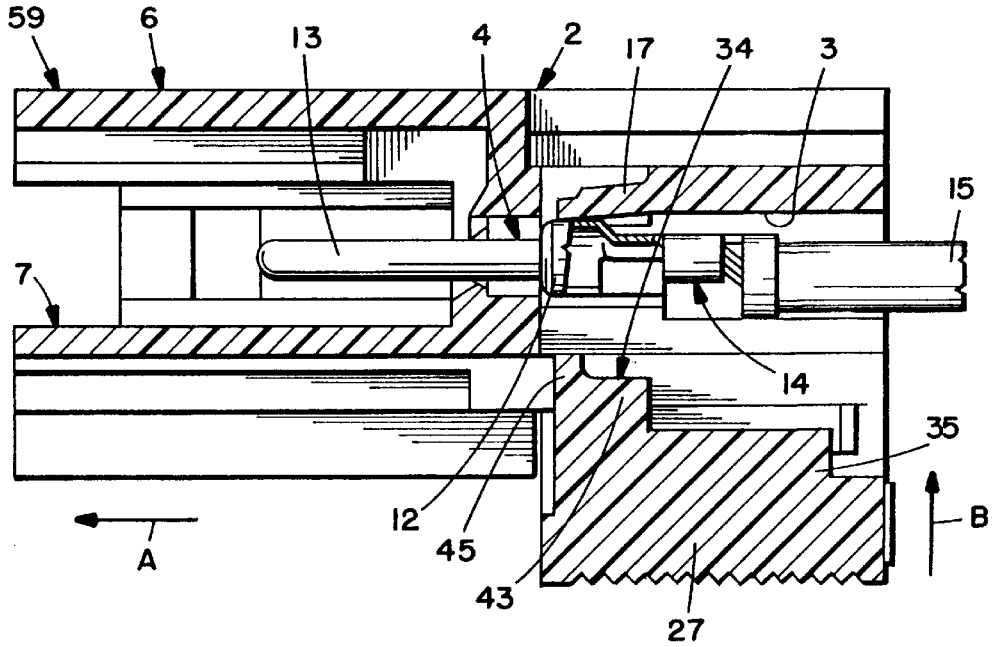
FIG. 16 shows a section along line XVI—XVI in FIG. 14.
Figure 17:
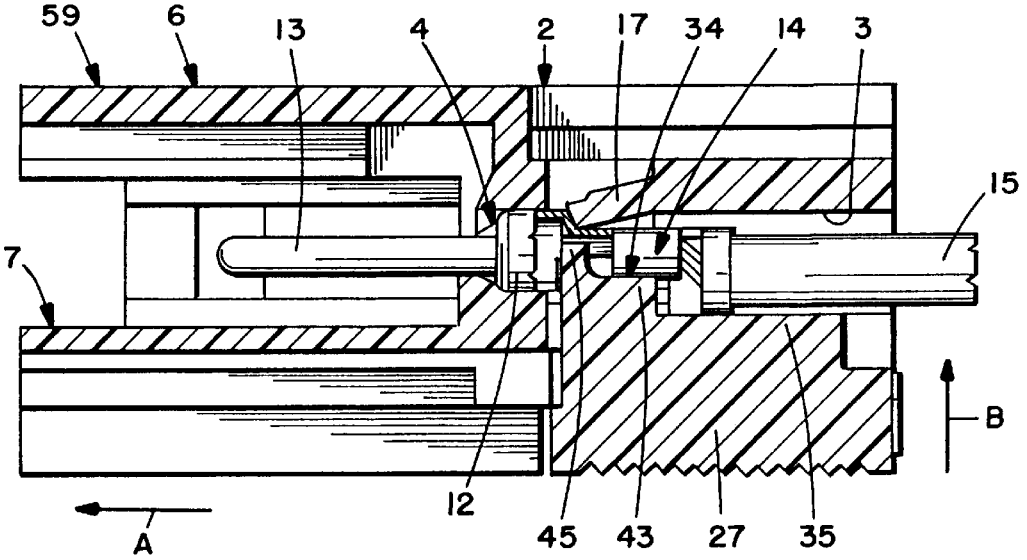
FIG. 17 shows a section along line XVII—XVII in FIG. 15.

Connector 59 operates in substantially the same way as connector 1; and passage from the deactivating to the activating position of secondary retaining device 26 is effected by simply pressing wall 27 so as to break beads 75 of connecting elements 74 and permit connection of wall 27 to casing 2 (FIG. 13).

As wall 27 moves towards casing 2, arms 61, 63 flex outwards so that respective teeth 66 slide along and snap behind ramps 67 into the locked position contacting sides 68; and, at the same time, the rear portion of wall 27 is locked by hook 48.

As shown in FIGS. 14 to 17, secondary retaining device 26 and terminals 4 cooperate in exactly the same way as described with reference to connector 1.

The advantages of connectors 1 and 59 in accordance with the teachings of the present invention will be clear from the foregoing description.

In particular, slidable movable element 27 is formed integrally with casing 2 in a preassembled position enabling insertion of terminals 4 and subsequent troublefree connection of element 27 to casing 2, substantially using two fingers; and device 26 is deactivated by simply detaching movable element 27 from casing 2, in which case, element 27 nevertheless remains attached to casing 2 by virtue of blades 28 of connector 1, and the interaction of arms 61–65 of connector 59.

Clearly, changes may be made to connectors 1, 59 as described and illustrated herein without, however, departing from the scope of the present invention.

For example, movable element 27 may slide axially as opposed to transversely in relation to casing 2, and be fitted to the front or rear of the casing; movable element 27 may cooperate with primary retaining means 17 as opposed to terminals 4; and provision may be made for any number of cavities 3 and for a casing 2 and terminals 4 of any form; in particular, the terminals may be male blade or female terminals of any type.

We claim:

1. An electric connector (1, 59) comprising an insulating casing (2) with at least one axial cavity (3); at least one electric terminal (4) housed inside said cavity (3); primary retaining means (17) for retaining said terminal (4) inside said cavity (3); and secondary retaining means (26) in turn comprising at least one movable element (27) which snaps on to the casing (2) into an activating position of said secondary retaining means (26) to determine correct engagement of the terminal (4) by said primary retaining means (17) and prevent withdrawal of the terminal (4); characterized in that said casing (2) and said movable element (27) are formed in one piece in the deactivating position of said secondary retaining means (26); said secondary retaining means (26) comprising yielding means (28; 74) integrally connecting said movable element (27) to said casing (2) at least in said deactivating position of said secondary retaining means (26); and said movable element (27) being movable between said deactivating and said activating positions by means of a straightforward translatory movement, wherein said movable element (27) slides in relation to said casing (2) in a direction (B) crosswise to the connection direction (A) of the connector (1).

2. A connector as claimed in claim 1, characterized in that said yielding connecting means comprise at least one flexible blade (28).

3. A connector as claimed in claim 2, characterized in that said yielding connecting means comprise two pairs of flexible blades (28) connecting opposite lateral portions (31) of said movable element (27) to respective opposite lateral portions (33) of said casing (2).

4. A connector as claimed in claim 3, characterized in that said blades (28) in each said pair are arranged facing each other, and present an elongated section crosswise to said translation direction (B) of said movable element (27) and to said connection direction (A) of the connector (1).

5. A connector as claimed in claim 1, characterized in that said yielding connecting means (74) comprise at least one breakable connecting portion (75).

6. A connector as claimed in claim 5, characterized in that said secondary retaining means (26) comprise mutual retaining means (60) for retaining said movable element (27) to said casing (2) and which are activated subsequent to breakage of said breakable portion (75), to prevent said movable element (27) from being fully detached from said casing (2).

7. A connector as claimed in claim 6, characterized in that said mutual retaining means comprise first arms (64, 65) extending from respective lateral portions (33) of said casing (2) towards said movable element (27); and second arms (61, 62, 63) extending from respective lateral portions (31) of said movable element (27) towards said casing (2); said first and second arms (64, 65; 61, 62, 63) being offset in relation to one another in said connection direction (A) of said connector (1), and being slidable in relation to one another in said translation direction (B) of said movable element (27).

8. A connector as claimed in claim 7, characterized in that said first and second arms (64, 65; 61, 62, 63) comprise snap-on mutual retaining means (66, 67, 68).

9. A connector as claimed in claim 1, characterized in that said casing (2) and said movable element (27) comprise centering means (40; 35, 36) for centering said movable element (27) in a direction crosswise to said translation direction (B) of said movable element (27) and to said connection direction (A) of said connector (1).

10. A connector as claimed in claim 9, characterized in that said secondary retaining means (26) comprise engaging means (34) projecting from said movable element (27) and which penetrate inside said cavity (3) to cooperate with said terminal (4) in said activating position of said secondary retaining means (26); said centering means comprising a tapered portion (36, 43) of said engaging means (34), and a corresponding lead-in seat (40) formed in said casing (2).

11. An electric connector (1, 59) comprising an insulating casing (2) with at least one axial cavity (3); at least one electric terminal (4) housed inside said cavity (3); primary retaining means (17) for retaining said terminal (4) inside said cavity (3); and secondary retaining means (26) in turn comprising at least one movable element (27) which snaps on to the casing (2) into an activating position of said secondary retaining means (26) to determine correct engagement of the terminal (4) by said primary retaining means (17) and prevent withdrawal of the terminal (4); characterized in that said casing (2) and said movable element (27) are formed in one piece in the deactivating position of said secondary retaining means (26); said secondary retaining means (26) comprising yielding connecting means integrally connecting said movable element (27) to said casing (2) at least in said deactivating position of said secondary retaining means (26); and said movable element (27) being movable between said deactivating and said activating positions by means of a straightforward translatory movement, wherein said yielding connecting means comprise two pairs of flexible blades (28) connecting opposite lateral portions (31) of said movable element (27) to respective opposite lateral portions (33) of said casing (2).

12. An electric connector (1, 59) comprising an insulating casing (2) with at least one axial cavity (3); at least one electric terminal (4) housed inside said cavity (3); primary retaining means (17) for retaining said terminal (4) inside said cavity (3); and secondary retaining means (26) in turn comprising at least one movable element (27) which snaps on to the casing (2) into an activating position of said secondary retaining means (26) to determine correct engagement of the terminal (4) by said primary retaining means (17) and prevent withdrawal of the terminal (4); characterized in that said casing (2) and said movable element (27) are formed in one piece in the deactivating position of said secondary retaining means (26); said secondary retaining means (26) comprising yielding connecting means (74) integrally connecting said movable element (27) to said casing (2) at least in said deactivating position of said secondary retaining means (26); and said movable element (27) being movable between said deactivating and said activating positions by means of a pushing movement, wherein said yielding connecting means (74) comprise at least one breakable connecting portion (75), and wherein said at least one breakable connecting portion is adapted to keep the movable element in the deactivating position and away from the activating position until the breakable connecting portion is broken.

13. A connector as claimed in claim 12, characterized in that said secondary retaining means (26) comprise mutual retaining means (60) for retaining said movable element (27) to said casing (2) and which are activated subsequent to breakage of said breakable portion (75), to prevent said movable element (27) from being fully detached from said casing (2).

14. A connector as claimed in claim 13, characterized in that said mutual retaining means comprise first arms (64, 65) extending from respective lateral portions (33) of said casing (2) towards said movable element (27); and second arms (61, 62, 63) extending from respective lateral portions (31) of said movable element (27) towards said casing (2); said first and second arms (64, 65; 61, 62, 63) being offset in relation to one another in said connection direction (A) of said connector (1), and being slidable in relation to one another in said translation direction (B) of said movable element (27).

15. A connector as claimed in claim 14, characterized in that said first and second arms (64, 65; 61, 62, 63) comprise snap-on mutual retaining means (66, 67, 68).

16. A connector as claimed in claim 12, characterized in that said casing (2) and said movable element (27) comprise centering means (40; 35, 36) for centering said movable element (27) in a direction crosswise to said translation direction (B) of said movable element (27) and to said connection direction (A) of said connector (1).

17. A connector as claimed in claim 16, characterized in that said secondary retaining means (26) comprise engaging means (34) projecting from said movable element (27) and which penetrate inside said cavity (3) to cooperate with said terminal (4) in said activating position of said secondary retaining means (26); said centering means comprising a tapered portion (36, 43) of said engaging means (34), and a corresponding lead-in seat (40) formed in said casing (2).

* * * * *